US006078780A

United States Patent [19]

Abe et al.

[11] Patent Number: 6,078,780

[45] **Date of Patent: *Jun. 20, 2000**

[54] IMAGE HEATING DEVICE AND IMAGE HEATING FILM

[75] Inventors: Atsuyoshi Abe, Susono; Takeshi Setoriyama, Kashiwa; Kazuo Kishino, Kawasaki; Keisuke Matsuo, Numazu; Hideyuki Hatakeyama, Yokohama, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/687,781

[22] Filed: Jul. 31, 1996

[30] Foreign Application Priority Data

Aug. 3, 1995 [JP] Japan ..... 7-219606

[51] Int. Cl.[7] ..... G03G 15/20

[52] U.S. Cl. ..... 399/328; 399/329; 219/619; 219/216; 492/46; 492/53

[58] Field of Search ..... 399/329, 330, 399/333, 328; 219/619, 670, 216, 469; 492/53, 56, 46; 430/124, 126, 99, 98

[56] References Cited

U.S. PATENT DOCUMENTS

| | | | |
|---|---|---|---|
| 5,253,027 | 10/1993 | Goto | 399/333 |
| 5,319,427 | 6/1994 | Sakurai et al. | 399/333 |
| 5,327,202 | 7/1994 | Nami et al. | 399/333 |
| 5,464,698 | 11/1995 | Chen et al. | 428/421 |
| 5,471,288 | 11/1995 | Ohtsuka et al. . | |
| 5,534,987 | 7/1996 | Ohtsuka et al. . | |
| 5,547,759 | 8/1996 | Chen et al. | 428/421 |
| 5,552,582 | 9/1996 | Abe et al. . | |
| 5,568,240 | 10/1996 | Ohtsuka | 399/335 |
| 5,666,627 | 9/1997 | Yamaguchi | 399/330 |
| 5,745,833 | 4/1998 | Abe et al. | 399/330 |
| 5,819,150 | 10/1998 | Hayasaki et al. | 399/330 |

FOREIGN PATENT DOCUMENTS 5-9027 2/1993 Japan .

*Primary Examiner*—Matthew S. Smith
*Attorney, Agent, or Firm*—Fitzpatrick, Cella, Harper & Scinto

[57] ABSTRACT

An image heating device is provided with a film having an electrical conductive layer, a magnetic flux generating unit. An eddy current is generated on the electrical conductive layer by the magnetic flux generated by the magnetic flux generating unit. The electrical conductive layer generates heat, and an image is heated by the heat of the film. The film is provided with an elastic layer arranged on the image side of the electrical conductive layer, and a primer layer is arranged between the electrical conductive layer and the elastic layer. It is possible to effectuate a heating fixation that can be started quickly with generating no nonuniformity in the image gloss and maintaining a high image quality.

28 Claims, 6 Drawing Sheets

IMAGE HEATING DEVICE AND IMAGE HEATING FILM

BACKGROUND OF THE INVENTION

1. Field of the Invention

The present invention relates to an image heating device applicable to a copying machine, a printer, and other image formation apparatuses. More particularly, the invention relates to an image heating device that causes a film to generate heat by means of electro-magnetic induction, and to a film to be used for such image heating.

2. Related Background Art

As a device using the conventional electro-magnetic induction heating method, there has been proposed in Japanese Patent Publication No. 5-9027 a device structured so that an alternating magnetic field causes eddy current to be generated in a core portion of a fixation roller serving as a heating member to give heat to the core portion with Joule's heat.

In conjunction with FIG. 9, this proposed device will be described. In FIG. 9, a reference numeral 50 designates a cylindrical fixation roller formed by a ferromagnetic material, which is heated by means of induction heating. The magnetic field indicated by arrows shown in broken line in FIG. 9 is generated by applying high frequency alternating current to an excitation coil 52 wound around an excitation iron core 51 to generate an eddy current on the fixation roller 50, to thereby perform heating.

In other words, the eddy current is generated on the fixation roller by means of magnetic flux to cause the fixation roller 50 itself to be heated by Joule's heat. A reference numeral 53 designates an auxiliary iron core for forming closed magnetic path and arranged to face the excitation iron core 51, interposing the fixation roller 50 between them. Also, a reference numeral 54 is a pressure roller having elasticity, which is pressurized to the fixation roller 50 by pressurizing means (not shown), a fixation nipping to form a fixation nipping portion N as a heating portion for thermally fixing a non-fixation toner image T on a recording member P.

The device using the electro-magnetic induction heating method, such a device shown in FIG. 9, can directly heat the fixation roller 50 as a heating member, and arrange its heating position near a non-fixation toner image. Therefore, it is possible to increase the efficiency of energy consumption more than a heating roller using a halogen heater.

However, this device has to heat the fixation roller having a great capacity heat as in a device using a heating roller. Also, the heat efficiency of the device is not enough because of heat dissipation into the interior of the roller. As a result, even when the device has an optimal heat efficiency, it is impossible to carry out quick starting. Also, when Joule's heat is generated by causing a cylindrical member to generate the eddy current, the temperature of the excitation coil and the excitation iron core in magnetic field generating means are increased thus reducing the quantity of magnetic flux. As a result, the heat generation becomes unstable. Also, if temperature rise is great, the excitation coil will deteriorate.

Under such circumstances, the applicant hereof has proposed an electromagnetic induction heating device that enables a film to generate heat, in U.S. patent application Ser. No. 08/323,789. Even with this device, however, it was not enough to thermally fix a thick non-fixation toner layer of maximum four color toner layers laminated in a color image formation apparatus, for example.

SUMMARY OF THE INVENTION

It is an object of the present invention to provide an image heating film capable of strengthening the binding between layers in the film formed by a plurality of layers having an elastic layer, and to provide an image heating device including such film.

It is another object of the invention to provide an image heating film having a primer layer between an electrical conductive layer and an elastic layer in the film having the electrical conductive layer and the elastic layer, and to provide an image heating device including such film.

It is still another object of the invention to provide an image heating film having a primer layer between an elastic layer and a release layer in the film having an electrical conductive layer, the elastic layer and the release layer, and to provide an image heating device including such film.

Other objects will be apparent from the description of a preferred embodiment of the invention which follow.

DETAILED DESCRIPTION OF THE PREFERRED EMBODIMENTS

Hereinafter, with reference to the accompanying drawings, the description will be made of the embodiments in accordance with the present invention.

(First Embodiment) (FIG. 1 to FIG. 4)

(1) Example of an Image Formation Apparatus

Figure 1:
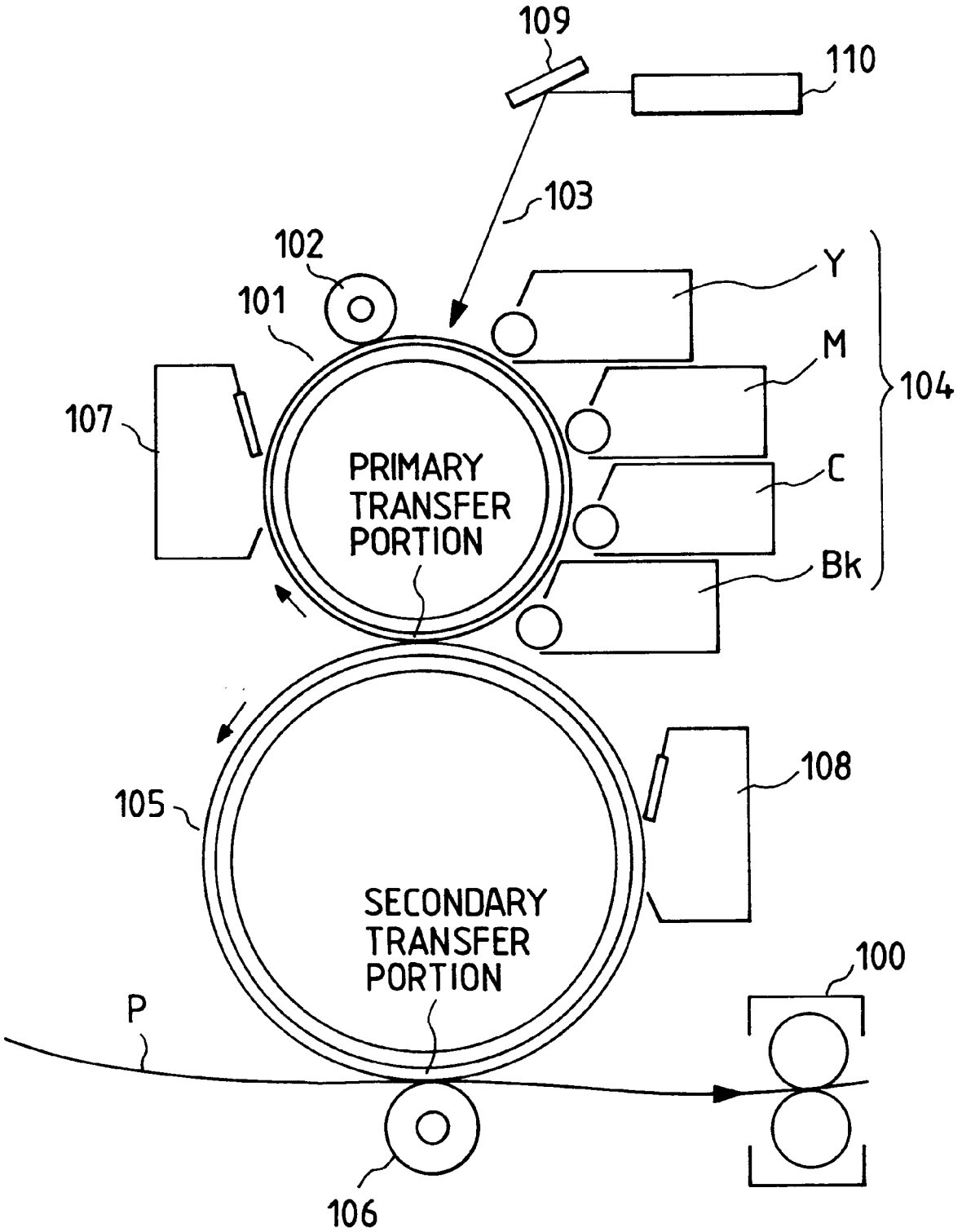
FIG. 1 is a schematic structural view showing an image formation apparatus.

FIG. 1 is a schematic structural view showing one example of an image formation apparatus to which an image heating device embodying the present invention is applicable. The image formation apparatus exemplified here is a color printer of a laser beam scanning exposure type that utilizes a transferable electro-photographic process.

A reference numeral 101 designates a photosensitive drum formed by an organic photosensitive material or an amorphous silicon photosensitive material. This drum is driven to rotate clockwise as indicated by an arrow at a given peripheral speed.

A reference numeral 102 designates a charging roller for charging the outer surface of the photosensitive drum 101 uniformly.

A reference numeral 110 designates a laser optical box for outputting signals from an image signal generator (not shown) after converting them into the on/off of the laser beam 103, and scanning the surface of the photosensitive drum 101 for exposure. A reference numeral 109 designates a mirror for deflecting the laser beam 103 output from the laser optical box 110 to the photosensitive drum 101.

A reference numeral 104 designates a color development unit, which comprises yellow, magenta, and cyan color developing devices Y, M, and C, and a black developing device Bk. These developing devices are selectively switched over to function with respect to the photosensitive drum 101.

A reference numeral 105 designates an intermediate transfer drum arranged to face the photosensitive drum 101. This drum is driven to rotate counterclockwise as indicated by an arrow in FIG. 1 at a peripheral speed corresponding to that of the photosensitive drum 101. The intermediate transfer drum 105 is provided with an elastic layer of medium resistance and a surface layer of high resistance on a metal drum. A bias voltage is applied to the metal drum to conduct a primary transfer of a toner image on the photosensitive drum 101 side to the curved surface of the intermediate transfer drum 105 by means of the potential difference between the metal drum and the photosensitive drum 101.

A reference numeral 106 designates a transfer roller arranged to face the intermediate transfer roller 105. This roller functions to conduct a second transfer of the toner image on the intermediate transfer drum 105 side to a recording member P supplied from a sheet supply cassette (not shown) at a given timing. A transfer bias having a polarity reverse to that of the toner is applied to the transfer roller 106.

A reference numeral 107 designates a cleaner for cleaning the surface of the photosensitive drum 101 after the primary transfer, and 108, a cleaner for cleaning the surface of the intermediate transfer drum 105 after the secondary transfer.

A first component color image (a yellow toner image, for example) constituting a color image is formed on the surface of the rotational photosensitive drum 101 by use of charge, exposure, and development process devices 102, 110, and 104 described above. This first component color image is primary-transferred to the surface of the intermediate transfer drum 105. The surface of the photosensitive drum 101 after the primary transfer is cleaned by the cleaner 107.

Then, a second component color image (a magenta toner image, for example) is formed on the surface of the rotational photosensitive drum 101. The second component color image is resistered, in a given manner, with the first color component image already primary-transferred, and is superposed thereon, thus being primary-transferred to the surface of the intermediate transfer drum 105.

Likewise, the formation of a third component color image (a cyan toner image, for example) and a fourth component color image (a black toner image, for example) on the surface of the rotational photosensitive drum 101, and the superposing primary transfer thereof on the surface of the intermediate drum 105 are performed in order, whereby a color toner image of component color images each superposed is synthetically formed on the surface of the intermediate transfer drum 105.

The color toner image synthetically formed on the surface of the intermediate transfer drum 105 is secondary-transferred to the surface of the recording member P at a time by means of the transfer roller 106.

The recording member P having received the secondary transfer of the color toner image is separated from the surface of the intermediate transfer drum 105, and fed to the heating fixation device 100 serving as a heating device (which will be described in the item (2) given below), then the heating fixation is conducted for the toner image to enable the different toner colors to be mixed. The recording member is then discharged as a color print.

(2) Heating Fixation Apparatus 100

Figure 2:
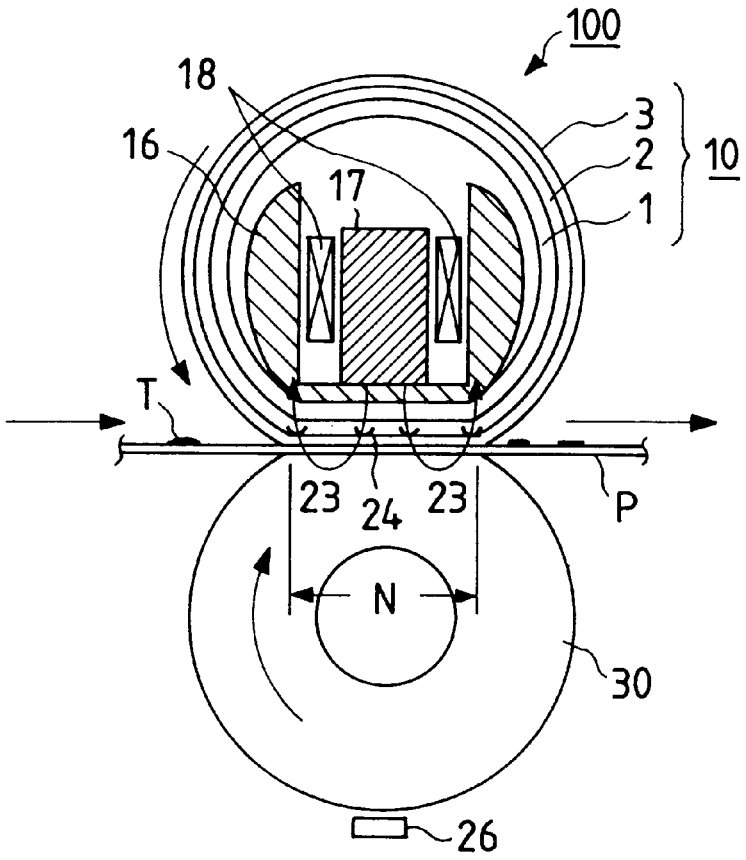
FIG. 2 is a schematic structural view showing an image heating fixation device serving as a heating device.

FIG. 2 is a schematic structural view showing a heating fixation device 100 serving as a heating device. The device 100 is a heating device of an electro-magnetic induction heating type that uses an electro-magnetic induction heating film (a film for heating) as a heating member including a heating layer that generates the electro-magnetic induction heat by the action of magnetic field.

A reference numeral 16 designates a film guide in the form of a gutter type having long sideways, which is longitudinal in the direction perpendicular to the surface of FIG. 2. This film guide 16 is, for example, molded product of liquid crystal polymeric phenol resin or the like.

Reference numerals 17 and 18 designate a high magnetic permeability core and excitation coil arranged in the groove inside the film guide as means for generating magnetic field (magnetic flux). The film guide 16 dually functions as a supporting member for the core 17 and the excitation coil 18. The excitation coil is formed by coil (winding) wound around the high magnetic permeability core (iron core, core) 17 having long sideways.

It is preferable to use ferrite, permalloy or other materials used for the core of a transformers. It is more preferable to use the ferrite whose loss is small even at more than 100 kHz.

To the coil 18, an excitation circuit (not shown) is connected. The excitation circuit is adapted to generate a high frequency of 20 kHz to 500 kHz by use of a switching power source. Magnetic flux generating means includes the excitation circuit.

A reference numeral 10 designates an electro-magnetic induction heating film including a heating layer as a heating member generating the electro-magnetic induction heat by the action of magnetic field. Hereinafter, this film is referred to as a fixation film. The fixation film 10 is made cylindrical, and fitted loosely over the film guide 16 having the core 17 and the excitation coil 18 arranged therefor. The layer structure of the fixation film 10 will be described in the next item (3).

A reference numeral 30 designates a pressure roller serving as a pressure member, which is structured by coating silicone rubber, fluoro-rubber, or the like around its core, and 26, a temperature sensing element arranged near to or in contact with the pressure roller 30 to control the temperature of the device.

As described above, the film guide 16 having the fixation film 10 fitted over the guide, and the pressure roller 30 are arranged vertically in parallel, and the lower face of the film guide 16 and the pressure roller 30 are in contact under pressure, interposing the fixation film 10 between them, thereby forming a fixation nipping portion N as a heating portion having a given width.

The pressure roller 30 is driven by driving means (not shown) to rotate clockwise as indicated by an arrow in FIG.

2, whereby the rotational force acts upon the fixation film 10 by means of the pressurized friction force between the pressure roller 30 and the outside surface of the fixation film 10 in the fixation nipping portion N, so that the fixation film is driven and rotated along the outer surface of the film guide 16 counterclockwise as indicated by an arrow in FIG. 2 while the inside face of the fixation film 10 is in contact closely with the lower face of the film guide 16 and slides thereon.

In a state that the pressure roller 30 is driven to rotate, and the fixation film 10 is driven and rotated, high frequency alternating current is applied from an excitation circuit (not shown) to the coil 18 of magmatic flux generating means. Also, the recording member P, as a member to be heated, which carries a non-fixed toner image T, is fed into the fixation nipping portion.

When the high frequency alternating current is applied to the coil 18, an alternating field acts upon the fixation nipping portion N concentrically. In the fixation nipping portion N, the heating layer (ferromagnetic electrical conductive layer) of a portion of the fixation film corresponding to the fixation nipping portion N becomes heating condition of electro-magnetic induction.

The heating principal in the fixation nipping portion is such that the magnetic flux generated by the electric current applied by the excitation circuit to the coil 18 is introduced into the high magnetic permeability core 17, thereby generating a magnetic flux 23 and an eddy current 24 on the heating layer of the heating film 10 in the fixation nipping portion N. By the eddy current and the inherent resistance of the heating layer, Joule's heat is generated. By this heat, the fixation film 10 itself is heated to raise its temperature rapidly, thus enabling the fixation nipping portion N to rise to a given fixation temperature within a short period. A temperature control system (not shown) including the temperature sensing element 26 for device temperature control controls the energization to the coil 18 of magnetic flux generating means, whereby the temperature of the fixation nipping portion N is controlled and adjusted to a given fixation temperature.

Also, the recording member P fed into the fixation nipping portion N is in contact closely with the outside surface of the fixation film 10, and fed by the fixation nipping portion N together with the fixation film 10 while being pinched. In the course of passing the fixation nipping portion N, the recording member is heated by the electro-magnetic induction heat on the fixation film portion corresponding to the fixation nipping portion N. Thus, non-fixed the toner image is softened and fused, and thermally fixed on the surface of the recording member P.

The softened and fused toner image on the recording member P come out the fixation nipping portion N is cooled to cause the recording member to be separated from the outside surface of the fixation film 10. The recording material is further fed and discharged.

(3) Layer structure of fixation film 10

Figure 3:
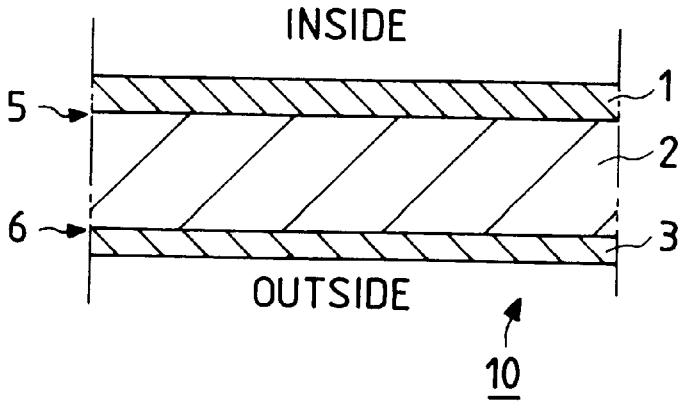
FIG. 3 is a schematic view which shows the layer structure of a fixation film serving as a heating film (electromagnetic induction heating film).
Figure 4:
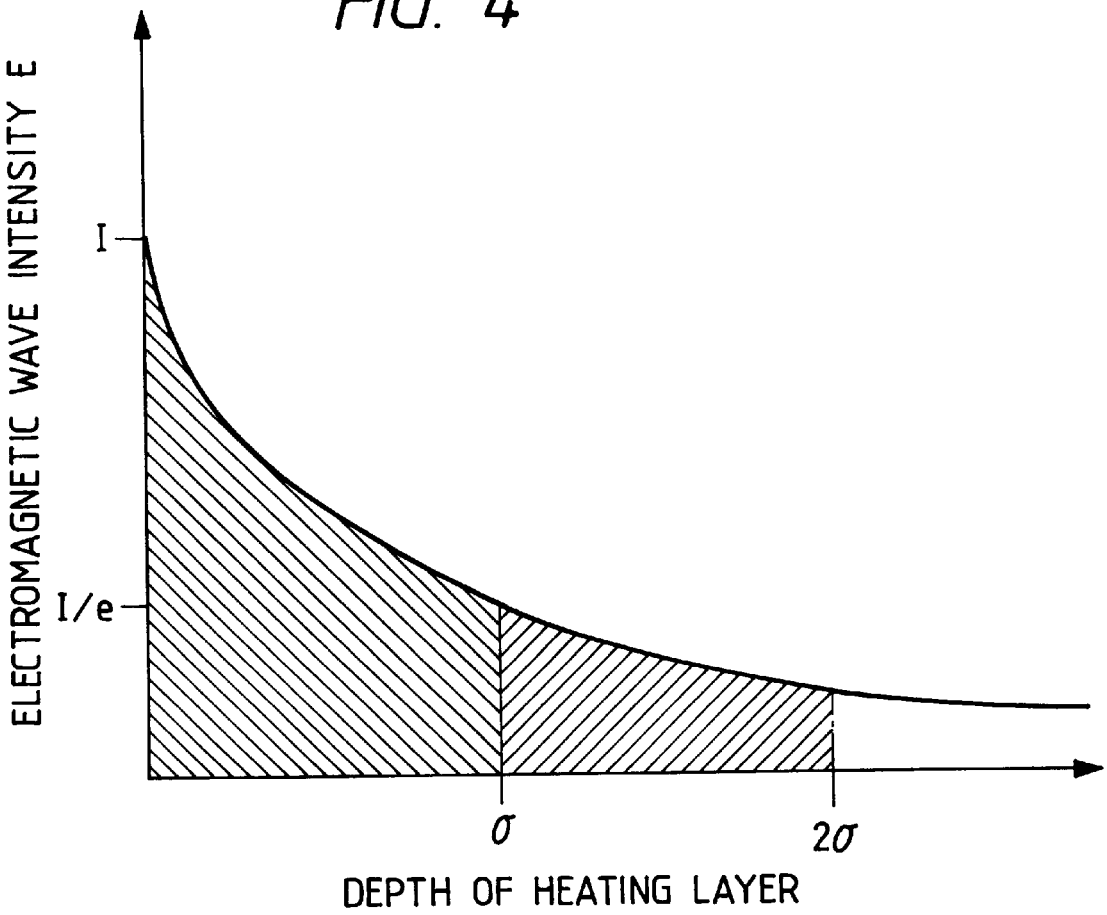
FIG. 4 is a graph which shows the relationship between the depth of a heating layer and the intensity of electromagnetic wave.

FIG. 3 is a schematic view which shows the fixation film 10 used as a heating film in the device in accordance with the embodiment of the present invention, that is, it shows the layer structure of an electro-magnetic induction heating film.

In accordance with the present embodiment, the fixation film 10 has a layer structure in which a heating layer 1 which generating heat by electro-magnetic induction by the action of magnetic field, an elastic layer 2, and a release layer 3 in order from the inside of the film on the film guide 16 side to the outside of the film (image side on the recording member) with which the recording member P is contacted.

a) Heating Layer 1

The heating layer 1 is an electrical conductive layer serving as a base layer of the fixation film 10, and is a metallic film or the like which generates heat by electro-magnetic induction by the action of magnetic field.

The heating layer 1 may be of a non-magnetic metal, but more preferably, is of metal such as nickel, iron, magnetic stainless steel, cobalt-nickel alloy, iron-nickel alloy, or the like, which present a good absorption of magnetic flux.

It is preferable to make the thickness of the heating layer 1 larger than skin depth σ, which can be expressed by the formula (1) given below, and less than 200 μm.

$$\sigma=503\times(\rho/f\mu)^{1/2} \quad (1)$$

where σ [m] is skin depth, f [Hz] is frequency of the excitation circuit, μ is magnetic permeability, and ρ [Ωm] is inherent resistance.

This formula expresses a depth of absorbing the electro-magnetic wave used in electro-magnetic induction. The intensity of electro-magnetic wave is less than 1/e at the depth larger than the skin depth σ. In other words most of the energy is absorbed to this depth (see FIG. 4).

Preferably, the thickness of the heating layer is 1 to 100 μm. If the thickness of the heating layer is less than 1 μm, most of the electro-magnetic energy cannot be absorbed, thus the efficiency deteriorates. Also, if the thickness of the heating layer is more than 100 μm, the rigidity becomes too high, and also the flexibility becomes unfavorable. It is, therefore, not realistic to use such layer as a rotating element.

b) Elastic Layer 2

An elastic layer 2 is a material having a good heat resistance and heat conductivity, such as silicone rubber, fluoro-rubber, or fluorosilicone rubber.

For bonding the elastic layer 2 and the heating layer 1 formed by ferromagnetic metal or the like, it is preferable to use a silicone rubber primer whose main components are silane coupling agent and catalyzer if silicone rubber or fluorosilicone rubber is used as the elastic layer 2, for example. Also, if fluoro-rubber is used as the elastic layer 2, it is preferable to use a fluoro-rubber primer whose main component is amino-silane coupling agent. In this case, the film thickness of the primer layer 5 described above is not necessarily limited, but preferably, it should be within a range of 1 μm to 30 μm. If the film thickness of the primer layer is less than 1 μm, the bonding force becomes weaker between the elastic layer and the heating layer. If the film thickness is more than 30 μm, the strength of the primer layer itself is low, thus, there is a problem that the cohesive failure of the primer layer tends to occur.

The thickness of the elastic layer 2 is preferably 10 to 1,000 μm. More preferably, it is 50 to 500 μm. This thickness is required to assure the quality of fixed images.

In printing a color image, particularly in a photographic image or the like, solid image is formed all over a large area on a recording member P. In this case, if the heating surface (release layer 3) cannot follow the irregularities of a recording member P or those of a toner layer, heating nonuniformity takes place, thus generating gloss nonuniformity depending on the portions where the amount of heat transfer is larger or smaller. The portion receiving a larger amount of heat transfer results in a higher glossiness. The portion receiving a smaller amount of heat transfer results in a lower glossiness.

Therefore, if the thickness of the elastic layer 2 is less than 10 μm, this layer cannot follow the irregularities of a recording member P or those of a toner layer, thus generating nonuniform gloss of an image. Also, if the thickness of the elastic layer 2 is more than 1,000 μm, the heat resistance of the elastic layer 2 becomes greater, making it difficult to realize the quick start.

If the hardness of the elastic layer 2 is too high, it becomes impossible to follow the irregularities of a recording member or a toner image, thus generating nonuniform gloss of an image. Therefore, it is preferable to make the hardness of the elastic layer 2 less than 60° (JIS-A). More preferably, it should be less than 45° (JIS-A).

Preferably, the heat conductivity λ of the elastic layer 2 is $6\times10^{-4}$ to $2\times10^{-3}$ [cal/cm·sec·deg.]. More preferably, it is $8\times10^{-4}$ to $1.5\times10^{-3}$ [cal/cm·sec·deg.].

If the heat conductivity λ is smaller than $6\times10^{-4}$ [cal/cm·sec·deg.], the heat resistance becomes greater, thus delaying the temperature rise on the surface layer of a fixation film 10. If the heat conductivity λ is larger than $2\times10^{-3}$ [cal/cm·sec·deg.], the hardness becomes too high, and compression permanent strain deteriorates.

c) Release Layer 3

For the release layer 3, a material having a good releaseability and heat resistance is selected, such as fluoro-resin (PFA, PTFE, FEP, or the like), silicone resin, fluoro-silicone rubber, fluoro-rubber, or silicone rubber.

For the bonding of the release layer 3 and the elastic layer 2, there are some cases where it is not particularly necessary to use primer such as both elastic and release layers being formed by silicone rubber or fluoro-rubber. However, if silicone rubber is used for the elastic layer 2, and fluoro-resin (PFA) is used for the release layer 3, in order to bond them a layer prepared by a mixture of fluoro-rubber and fluoro-resin is formed on an amino-silane coupling agent to provide a primer layer 6 in some cases.

The thickness of the release layer 3 is preferably 1 to 100 μm. If the thickness is less than 1 μm, coating nonuniformity may result in the coated film, thus creating a portion having poor releasability, or a problem of insufficient durability. Also, if the thickness exceeds 100 μm, a problem will rise that heat conductivity deteriorates, particularly for the resin release layer, the hardness becomes too high, so that the effect of the elastic layer 2 described earlier is lost.

With the arrangement as described above, it is possible to effectuate a heating fixation that can be started quickly with generating no nonuniformity in the image gloss and maintaining a high image quality.

In accordance with the present embodiment, the film is provided with an elastic layer as described above. The elastic layer enables a heating film to follow the irregularities of a member to be heated and to contact closely with the surface of the member to be heated, whereby heat of the heating film is transferred uniformly to the member to be heated. Therefore, a non-fixed color toner image formed by different color toners superposed, can be fixed on a recording member in good condition.

Also, in a film having a plurality of layers including an elastic layer, a primer layer is provided between the electrical conductive layer and the elastic layer, and the elastic layer and the release layer, whereby binding between each layers is strengthened so as to make it possible to carry out a fixation in good condition without peeling off the film.

In this respect, as the toner T used in the image formation apparatus in the present embodiment, a toner including a low softening substance is adopted. Therefore, no oil coating mechanism for preventing offset is arranged in the heating fixation device 100, but an oil coating mechanism may be provided in the device if it is intended to use a toner that does not include any low softening substance. Also, it may be possible to arrange a cooling unit on the downstream side than the fixation nipping portion N in the recording member feeding direction to effectuate cooling separation. Also, in a case where a toner including a low softening substance is used, it may be possible to execute an oil coating treatment and cooling separation.

For the present embodiment, the description has been made of a four-color image formation apparatus, but the invention is applicable to a monochromatic image formation apparatus or a one-pass multicolor image formation apparatus.

Figure 5:
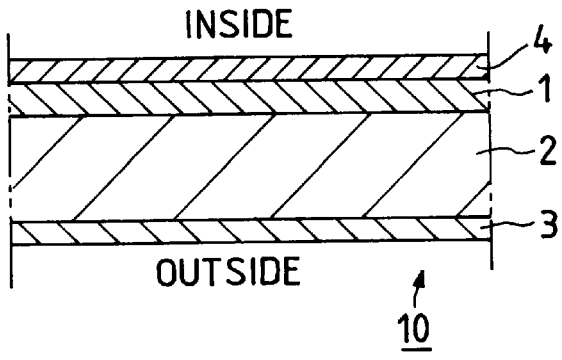
FIG. 5 is a schematic view which shows the layer structure of a fixation film serving as a heating film (electromagnetic induction heating film) in accordance with a second embodiment of the present invention.

(Second Embodiment) (FIG. 5)

FIG. 5 is a view which schematically shows the layer structure of a fixation film 10 in accordance with a second embodiment of the present invention. To the layer structures 1, 2, and 3 of the fixation film 10 shown in FIG. 3 representing the first embodiment described above, a heat insulating layer 4 is added to the film guide 16 side (the side opposite to the image) which is a back face of the heating layer 1. All aspects other than this arrangement are the same as those of the fixation film and device of the first embodiment.

As the insulating layer 4, it is preferable to use a heat resistive resin, such as fluoro-resin, polyimide resin, polyamide resin, polyamide-imide resin, PEEK resin, PES resin, PPS resin, PFA resin, PTFE resin, or FEP resin.

The thickness of the heat insulating layer 4 is preferably 10 to 1,000 μm. If the thickness of the insulating layer 4 is less than 10 μm, it is impossible to obtain any insulation effect, and its durability becomes insufficient. On the other hand, if it exceeds 1,000 μm, the distance from the high magnetic permeability core 17 of magnetic flux generating means to the heating layer becomes too great to absorb the magnetic flux into the heating layer sufficiently.

When the fixation film 10 in the present embodiment is used, it is possible to insulate the heat generated on the heating layer 1 by means of the heat insulating layer 4 so as not to be directed to the inside of the fixation film 10 as compared with the first embodiment, thus the efficiency of heat supply to the member to be heated is enhanced as compared with the case where no heat insulating layer 4 is present. Therefore, it is possible to suppress the dissipation of electric power more than the first embodiment, while obtaining the effects equally as the first embodiment.

The heat insulating layer 4 can suppress the heat transfer from the fixation film 10 side to the magnetic flux generating means side, thus serving to prevent adverse effects due to the temperature rises of the core and excitation coil.

Figure 6:
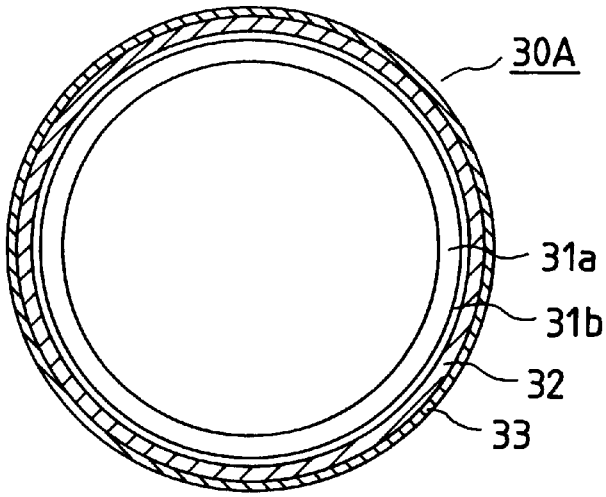
FIG. 6 is a schematic view which shows the layer structure of a heating pressure roller serving as a heating pressure member (electro-magnetic induction heating member) in accordance with a third embodiment of the present invention.

(Third Embodiment) (FIG. 6)

The present embodiment is such that, in an image heating fixation device 100 serving as a heating device in the first embodiment or the second embodiment, the pressure roller 30 as a pressure member, is also made an electromagnetic induction heating member (heating pressure member, and heating pressure roller).

FIG. 6 is a schematic view which shows the layer structure of a heating pressure roller 30A. The heating pressure roller 30A is provided with a heating layer 31*b* generating an electro-magnetic induction heat by action of magnetic field, on the core 31*a* made of aluminum or the like, and further with an elastic layer 32 and a release layer 33 on the heating layer 31 in that order.

The material of the heating layer 31*b* may be a non-magnetic metal, similarly to the heating layer of the fixation film 10 serving as an electro-magnetic induction heat generating film as described earlier. More preferably, however, it should be a ferromagnetic material having a g ood absorption of magnetic flux, such as nickel, iron, magnetic stainless steel, cobalt-nickel alloy, iron-nickel alloy or the like.

For the material of the elastic layer 32, it is preferable to use silicone rubber, fluoro-rubber, fluorosilicone rubber, or the like having a good heat resistance, and a good heat conductivity as well.

For the release layer 33, a material having a good releasability and heat resistance is selected, such as fluoro-resin (PFA, PTFE, FEP, or the like), silicone resin, fluorosilicone rubber, fluoro-rubber, or silicone rubber.

Between the heating layer 31*b*, elastic layer 32, and release layer 33, primer layers are formed as required, respectively, in the same manner as the first embodiment, to execute binding between layers.

As described above, the pressure roller is also formed by the electromagnetic induction heat generating material, so that the heat generating layer 1 on a portion of the fixation film 10 corresponding to the fixation nipping portion N becomes in a state of generating the electro-magnetic induction heat by the magnetic field that acts upon the fixation nipping portion N, and at the same time, the heating layer 31*b* on a portion of the heating pressure roller 30A corresponding to the fixation nipping portion N also becomes in the state of generating the electro-magnetic induction heat. Hence, the total heating amount in the fixation nipping portion N is increased, and a recording member P fed into the fixation nipping portion N as a member to be heated is heated from its both front and back sides (both sides heating).

It is preferable to allow the thickness of the heating layer 1 of the fixation film 10 not to exceed the skin depth $\sigma$ expressed by the formula (1) described earlier when the pressure roller is also formed by the electro-magnetic induction heat generating material 30A. This is because the energy supplied to the heating layer 31*b* on the heating pressure roller 30A side becomes smaller if exceeds the skin depth.

Further, it is preferable to make the sum of the thickness of the heating layer 1 on the fixation film 10 side and the thickness of the heating layer 31*b* on the heating pressure roller 30A side greater than the skin depth, and to make the thickness of the heating layer 1 on the fixation film 10 side smaller than the skin depth. This is readily understandable from the characteristics of the electromagnetic wave absorption described earlier.

The actual thicknesses of the heating layer 1 on the fixation film 10 side and the heat generating layer 31*b* on the heating pressure roller 30A side are determined by frequency of the excitation circuit and the resistance and magnetic permeability of the heating layer to be used when the required quantity of heat is determined. In this case, there is no need for the heat generating layer 1 on the fixation film 10 side and the heating layer 31*b* on the heating pressure roller 30A side to be formed by the same material.

The device as the present embodiment is structured to conduct a both sides heating of a recording member as a member to be heated by the pressure roller formed by an electro-magnetic induction heat generating material in cooperation with the fixation film 10. Therefore, such device is suitable for use as an image heating fixation device for a middle high speed image formation apparatus (whose process speed is 50 mm/sec or more). In other words, even if the period of time for a recording member to pass the fixation nipping portion N, which is a pressure portion formed by the heating film 10 and the pressure roller 30, is short as in a middle high speed machine, it is possible for this device to heat the recording member sufficiently. For a color image recording apparatus that performs the fixation process of a thick toner image, which is formed by maximum four layers of toner images superposed, it is possible to supplement the quantity of heat needed for executing such fixation from both sides of the recording member by means of the both sides heating, and to make it possible to speed up the heating fixation without causing any defects.

Figure 7:
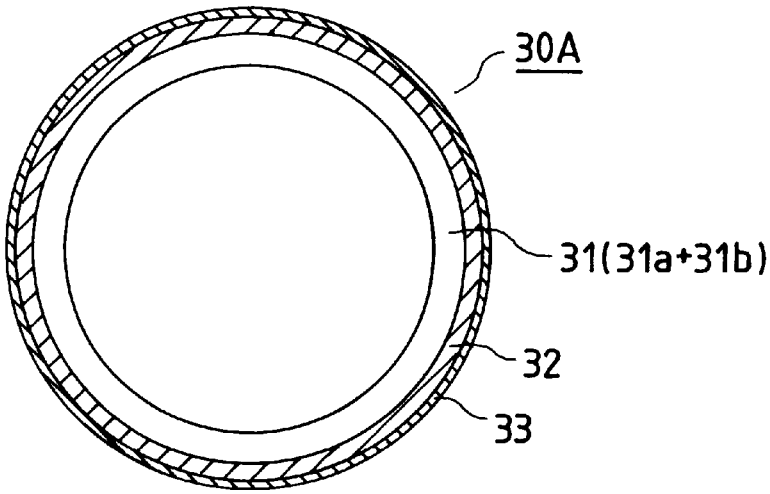
FIG. 7 is a schematic view which shows the layer structure of a heating pressure roller serving as a heating pressure member (electro-magnetic induction heating member) in accordance with a fourth embodiment of the present invention.

(Fourth Embodiment) (FIG. 7)

In accordance with the present embodiment, the core 31*a* and the heat generating layer 31*b* of the heating pressure roller 30A in the third embodiment described above are made by a single rigid heating layer 31 of the same material as shown in FIG. 7.

In other words, in the heating pressure roller 30A of the third embodiment there is the heat transfer from the heating layer 31*b* to the core 31*a*, but in accordance with the structure of the present embodiment, the heating layer 31*b* dually functions as a core 31*a*. Therefore, it is possible to reduce heat loss, and achieve the further enhancement of heat efficiency. The dissipation of energy can be reduced accordingly.

Figure 8A:
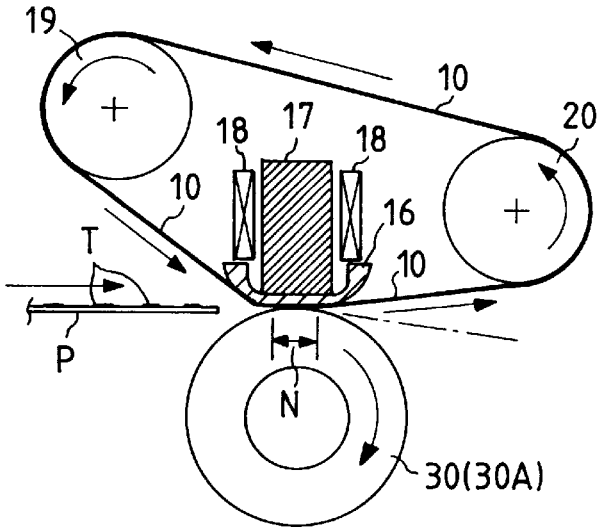
FIGS. 8A, 8B and 8C are schematic views showing the other structural modes of the heating device embodying the present invention, respectively.
Figure 8B:
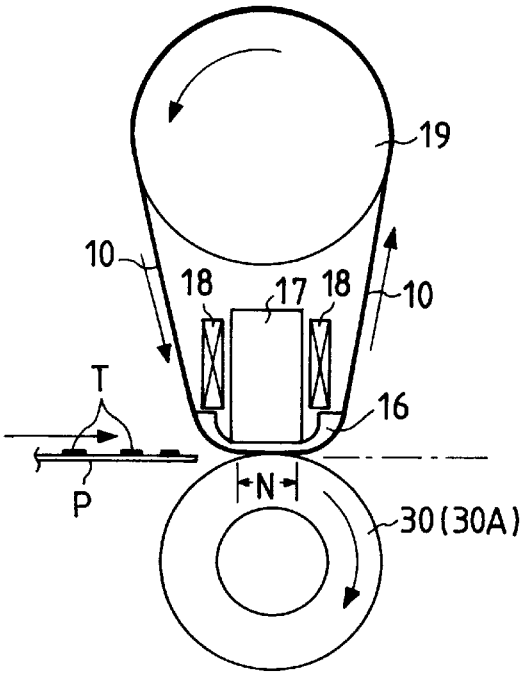
Figure 8C:
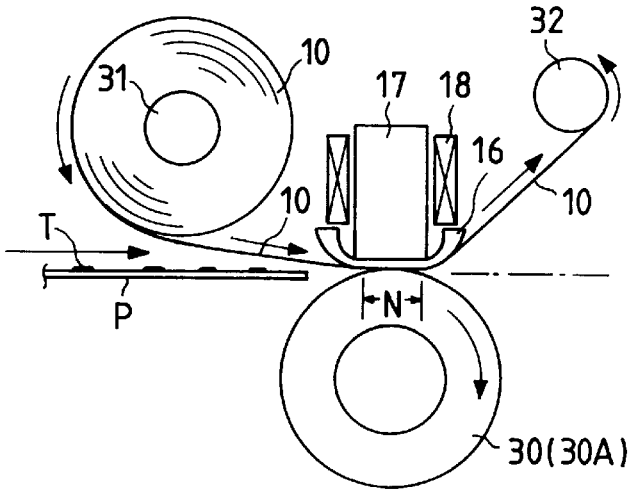
Figure 9:
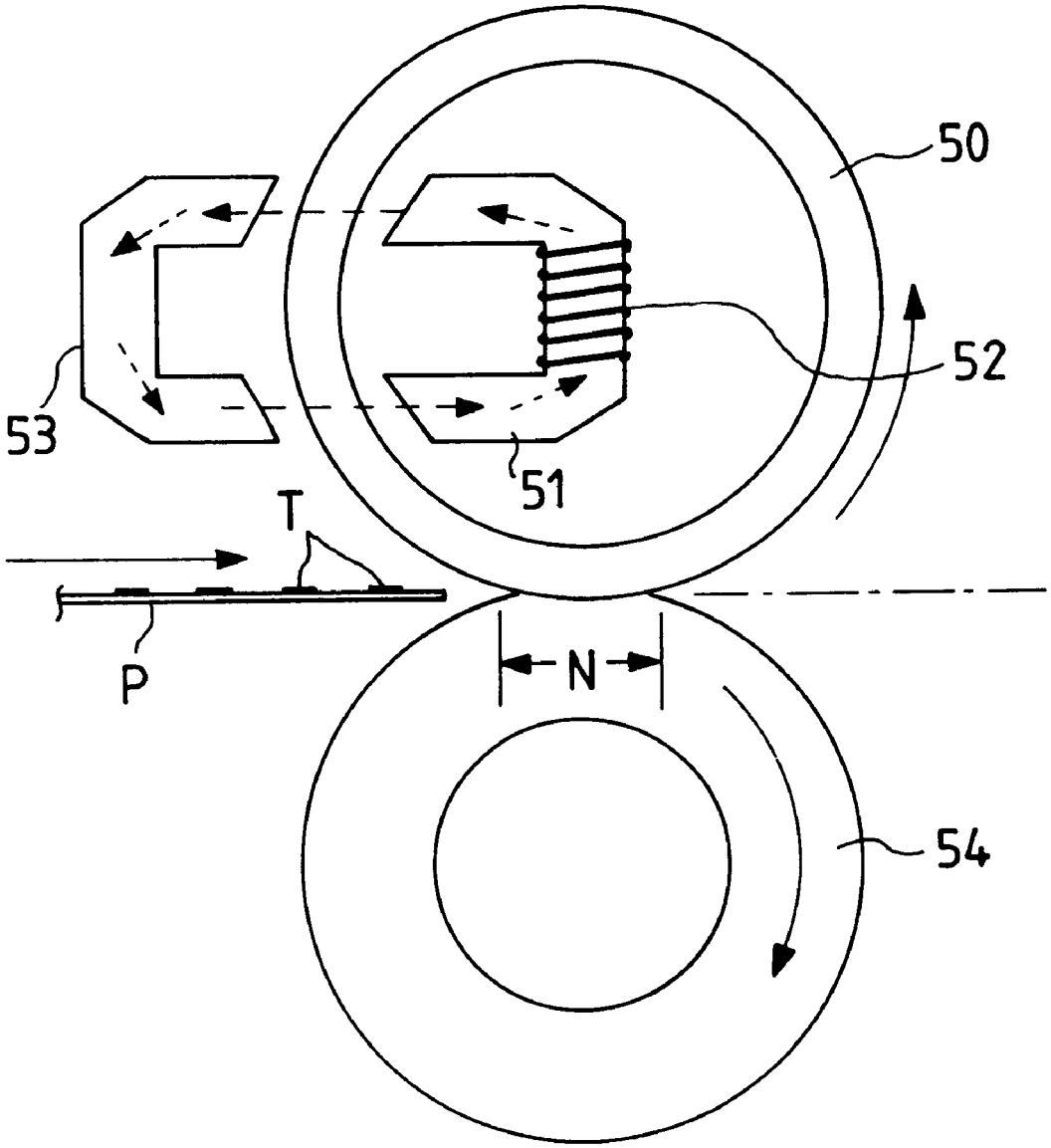
FIG. 9 PRIOR ART
FIG. 9 is a schematic view which shows a heating fixation device of an electro-magnetic induction heating type in accordance with the prior art.

FIGS. 8A, 8B and 8C are views showing other structures of heating devices embodying the present invention, each of them using an electro-magnetic induction heat generating film 10 as a heating film to which the present invention is applicable.

In the device shown in FIG. 8A, an endless belt type heating film (fixation film) 10 is stretched around three members, that is, a film guide 16, a driving roller 19, and a tension roller 20, which are arranged in substantially parallel to each other. On the inside of the film guide 16, excitation coils 17 and 18 are arranged. On the lower end of the film guide 16, a heating portion (fixation nipping portion) N is formed by pressing a pressure roller 30 or a heating pressure roller 30A, which is an electro-magnetic induction heat generating member, onto the lower face of the film guide 16, interposing the heating film 10 between them.

The inner face of the heating film 10 slides on the lower face of the film guide 16 while it is in contact closely therewith, thus the heating film 10 rotates counter-clockwise around the three members, that is, the film guide 16, driving roller 19 and tension roller 20, when the driving roller 19 is driven to rotate counterclockwise as indicated by an arrow in FIG. 8A. The pressure roller 30 (30A) rotates with following the rotation of the heating film 10.

A member P to be heated (recording member) is fed into the heat nipping portion N and pinched by the heating film 10 and the pressure roller 30 (30A), thus executing a heating process.

In the device shown in FIG. 8B, an endless belt type heating film 10 is streched around two members, that is, a film guide 16 provided with excitation coils 17 and 18 on its inner side, and a driving roller 19, and is arranged to rotate when the driving roller 19 is driven to rotate. The pressure roller 30 (30A) is a driven rotation roller.

In the device shown in FIG. 8C, a heating film 10 is wound around a feeding shaft 31 like a roll to be made an elongated film having its ends, and such film 10 passes through a contact nipping portion formed by a film guide 16 provided with excitation coils 17 and 18 on its inner side, and a pressure roller 30 (30A), and is engaged with a winding shaft 32, then is wound around the winding shaft 32 thus enabling the heating film to travel on the heat nipping portion N at a given speed. The pressure roller 30 (30A) is a driven rotation roller.

In accordance with each of the devices embodying the present invention, it is possible to obtain the same effects if the film 10 and the pressure roller 30 (30A) are provided with the same layer structures as the first to fourth embodiments.

In this respect, the heating device according to the present invention can be used widely, of course, not only as an image heating fixation device, but also, as a device capable of improving the quality of the surface (luster or the like) by heating a recording member that carries images, a device to conduct a provisional process of fixation, and a heating device for feeding sheet material for drying process, laminating treatment, or the like.

Although the present invention has been described with reference to the specific embodiments, the invention is not limited to such embodiments. Various modifications can be made within the scope of technical concept of the present invention.

What is claimed is:

1. An image heating device, comprising:

a film having an electrical conductive layer and moveable with a recording member;

magnetic flux generating means for generating magnetic flux which produces eddy current in said film to generate heat therein to heat an image on said recording member, wherein said film has an elastic layer at a side nearer to said recording member than said electrical conductive layer, and a primer layer between said electrical conductive layer and said elastic layer, wherein a hardness of said elastic layer is less than 60° (JIS-A).

2. A device according to claim 1, wherein said elastic layer is of silicone rubber, and said primer layer is of silicone rubber primer.

3. A device according to claim 2, wherein a main component of said silicone rubber primer is silane coupling agent and catalyzer.

4. A device according to claim 1, wherein said elastic layer is of fluoro-rubber, and said primer layer is of fluoro-rubber primer.

5. A device according to claim 4, wherein a main component of said fluoro-rubber primer is aminosilane coupling agent.

6. A device according to claim 1, wherein a thickness of said primer layer is 1 to 30 $\mu$m.

7. A device according to claim 1, wherein said film includes a release layer arranged on said recording member side of said elastic layer, and a primer layer arranged between said elastic layer and said release layer.

8. A device according to claim 1, wherein said film includes a heat insulating layer on an opposite side to said recording member side of said electrical conductive layer.

9. A device according to claim 1, wherein said film is of an endless type, and said recording member is outside said film.

10. A device according to claim 1, further comprising a pressure roller forming a nip with said film, wherein a recording member carrying a non-fixed image on said film side is pinched and fed at said nip to fix the non-fixed image on the recording member.

11. A device according to claim 10, wherein said non-fixed image is a color toner image of a plurality of color toners superposed thereon.

12. An image heating device, comprising:

a film having an electrical conductive layer and moveable with a recording member;

magnetic flux generating means for generating a magnetic flux which produces eddy current in said film to generate heat therein to heat an image on said recording member, wherein said film has an elastic layer at a side nearer to said recording member than said electrical conductive layer, a release layer at a side nearer to said recording member than said elastic layer, and a primer layer between said elastic layer and said release layer, wherein a hardness of said elastic layer is less than 60° (JIS-A).

13. A device according to claim 12, wherein said elastic layer is of silicone rubber and said release layer is of fluoro-resin, and said primer layer is provided with a layer of a mixture of fluoro-rubber and fluoro-resin on aminosilane coupling agent.

14. A device according to claim 12, wherein said film includes a heat insulating layer on an opposite side to said recording member side of said electrical conductive layer.

15. A device according to claim 12, wherein said film is of an endless type, and said recording member side is outside said film.

16. A device according to claim 12, further comprising a pressure roller forming a nip with said film, wherein a recording member carrying a non-fixed image on said film side is pinched and fed at said nip to fix the non-fixed image on the recording member.

17. A device according to claim 16, wherein said non-fixed image is a color toner image of a plurality of color toners superposed thereon.

18. An endless film for image heating comprising:

an electrical conductive layer;

an elastic layer provided outside said electrical conductive layer; and a primer layer between said electrical conductive layer and said elastic layer, wherein a hardness of said elastic layer is less than 60° (JIS-A).

19. An endless film according to claim 18, wherein said elastic layer is of silicone rubber, and said primer layer is of silicone rubber primer.

20. An endless film according to claim 19, wherein a main component of said silicone rubber primer is silane coupling agent and catalyzer.

21. An endless film according to claim 18, wherein said elastic layer is of fluoro-rubber, and said primer layer is of fluoro-rubber primer.

22. An endless film according to claim 21, wherein a main component of said fluoro-rubber primer is aminosilane coupling agent.

23. An endless film according to claim 18, wherein a thickness of said primer layer is 1 to 30 $\mu$m.

24. A device according to claim 18, further comprising a release layer provided outside said elastic layer and a second primer layer between said elastic layer and said release layer.

25. A device according to claim 18, further comprising a heat insulating layer provided inside said electrical conductive layer.

26. An endless film for image heating comprising:

an electrical conductive layer;

an elastic layer provided outside said electrical conductive layer;

a release layer provided outside said elastic layer; and a primer layer between said elastic layer and said release layer, wherein a hardness of said elastic layer is less than 60° (JIS-A).

27. An endless film for image heating according to claim 26, wherein said elastic layer is of silicone rubber and said release layer is of fluoro-resin, and said primer layer is provided with a layer of a mixture of fluoro-rubber and fluoro-resin on aminosilane coupling agent.

28. An endless film for image heating according to claim 26, further comprising a heat insulating layer provided inside said electrical conductive layer.

* * * * *

UNITED STATES PATENT AND TRADEMARK OFFICE

CERTIFICATE OF CORRECTION

PATENT NO. : 6,078,780
DATED : June 20, 2000
INVENTOR(S) : Atsuyoshi Abe, et al.

It is certified that error appears in the above-identified patent and that said Letters Patent is hereby corrected as shown below:

Column :
Line 48, "capacity heat" should read -- heat capacity --.

Column 3:
Line 57, "resistered" should read -- registered --.

Column 5:
Line 13, "magmatic" should read -- magnetic --;
Line 24, "principal" should read --principle --;
Line 52, "come out" should read -- which has come out of --;
Line 62, "in which a heating layer 1 which" should read -- comprises a heating layer 1 in which heat is generated --; and
Line 63, "generating heat" should be deleted.

Column 7:
Line 38, "rise" should read -- arise --; and
Line 59, "layers" should read -- layer --.

Column 8:
Line 67, "g ood" should read -- good --.

UNITED STATES PATENT AND TRADEMARK OFFICE

CERTIFICATE OF CORRECTION

PATENT NO. : 6,078,780
DATED : June 20, 2000
INVENTOR(S) : Atsuyoshi Abe, et al.

It is certified that error appears in the above-identified patent and that said Letters Patent is hereby corrected as shown below:

Column 9:
Line 34, "if" should read -- if it --.

Column 10:
Line 24, "in" should be deleted.

Signed and Sealed this

Fourteenth Day of August, 2001

*Attest:*

Nicholas P. Godici

*Attesting Officer*

NICHOLAS P. GODICI
*Acting Director of the United States Patent and Trademark Office*